US007513230B2

(12) United States Patent
Knecht et al.

(10) Patent No.: US 7,513,230 B2
(45) Date of Patent: Apr. 7, 2009

(54) CAMSHAFT ADJUSTING DEVICE

(75) Inventors: Andreas Knecht, Kusterdingen (DE); Helmut Patze, Lohr (DE); Udo Diederichs, Nürtingen (DE); Udo Schwandt, Dietenheim (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 222 days.

(21) Appl. No.: 10/578,527

(22) PCT Filed: Jun. 27, 2005

(86) PCT No.: PCT/EP2005/052547

§ 371 (c)(1),
(2), (4) Date: May 8, 2006

(87) PCT Pub. No.: WO2006/018330

PCT Pub. Date: Feb. 23, 2006

(65) Prior Publication Data

US 2008/0115751 A1 May 22, 2008

(30) Foreign Application Priority Data

Aug. 17, 2004 (DE) ..... 10 2004 039 800

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31, 90.6; 464/1, 2, 160

See application file for complete search history.

(56) References Cited

U.S. PATENT DOCUMENTS

| | | | | |
|---|---|---|---|---|
| 6,053,139 | A | 4/2000 | Eguchi et al. | 123/90.17 |
| 6,408,807 | B1 * | 6/2002 | Komazawa et al. | 123/90.17 |
| 6,684,835 | B2 * | 2/2004 | Komazawa et al. | 123/90.17 |
| 6,701,877 | B1 | 3/2004 | Ottersbach et al. | 123/90.17 |
| 6,820,578 | B2 | 11/2004 | Kanada et al. | 123/90.15 |
| 2002/0023602 | A1 | 2/2002 | Komazawa et al. | 123/90.15 |

FOREIGN PATENT DOCUMENTS

| | | |
|---|---|---|
| CN | 25 92 932 | 12/2003 |
| DE | 38 24 205 | 1/1990 |
| DE | 198 16 069 | 10/1999 |
| DE | 198 47 705 | 4/2000 |
| DE | 198 53 670 | 5/2000 |
| EP | 1 316 723 | 6/2003 |

* cited by examiner

*Primary Examiner*—Ching Chang
(74) *Attorney, Agent, or Firm*—Gudrun E. Huckett

(57) ABSTRACT

A camshaft adjusting system for an internal combustion engine has a camshaft adjusting device with a first hydraulic chamber and a second hydraulic chamber, wherein the first and second hydraulic chambers act in opposition to one another. A control valve group working as a 4/4-way valve system has a first connection to the first hydraulic chamber, a second connection to the second hydraulic chamber, a tank connection, and a connection for pressurization. The camshaft adjusting system in a first state of the control valve group, when starting the internal combustion engine, is pressure-relieved relative to the tank connection by simultaneously hydraulically connecting the first and second connections of the camshaft adjusting device so that the camshaft adjusting device moves into a dwell position with a single locking mechanism. The dwell position also provides a safety function in case of system failure.

15 Claims, 13 Drawing Sheets

Regular Position

Advance Position

Retarded Position

CAMSHAFT ADJUSTING DEVICE

BACKGROUND OF THE INVENTION

The invention relates to a camshaft adjusting system according to the preamble of the independent claim.

Camshaft adjusting systems consist of a number of different components. The number of the components may vary, although a common feature of many camshaft adjusting systems lies in the presence of a camshaft adjusting device and a control valve or a control valve group. There are different types of camshaft adjusting devices, all of which can rotate the relative position of a camshaft with respect to a further shaft, such as the crankshaft, of an internal combustion engine. One type of camshaft adjusting device which is frequently used is the oscillating motor camshaft adjusting device. An oscillating motor camshaft adjusting device is a rotatory vane-type motor which converts the hydraulic pressurization of one chamber with respect to another chamber into rotatory movement. The two chambers, which act in opposition, are separated by a mobile vane which changes the position according to pressure ratios. The camshaft, which is connected to the camshaft adjusting device, is in turn entrained and rotated in its position as a result of the change in position. The number of chambers of one direction of action, the number of vanes and the number of chambers of the opposite direction of action frequently correspond. Chambers of the same type are hydraulically interconnected. The chambers lead to a control valve group or a control valve. The functionality of a large-scale integrated control valve can be imitated through a skillful connection of a plurality of control valves. Considered in hydraulic terms, control valve groups consisting of a plurality of valves are consequently similar to control valves which consist of a single control valve provided with a plurality of connections. It is therefore to be assumed that the chambers of the first direction of action are all directly or indirectly interconnected and the chambers of the second direction of action lead to a further connection of the control valve group. The connections A and B are referred to in simplified terms.

It is desirable to know the relative position of the camshaft with respect to its reference shaft, in particular in the case of extraordinary operating states of the internal combustion engine. The patent literature discloses numerous proposals in which a defined position can be deduced by using special locking mechanisms. An example can be found in the German patent application DE 102004012460 A (HYDRAULIK-RING GMBH). - - - ., in which locking positions can be selected and planned through a skillful combination of a camshaft adjusting device with a spring.

Other areas of hydraulic motor vehicle technology disclose particular valves which, through their configuration, produce delays of a switching response in selected operating states.

DE 19816069 A (HYDRAULIK-RING GMBH). - - - . describes a valve which can preferably be used for automated manually shifted transmissions. A piston, which can be pressurized on both sides and which separates two pressure spaces from one another, is controlled via a valve with a safety function. In the zero switched position, the safety position, the three-way proportional valve does not have to close the coupling suddenly in the case of a disturbance.

Other valves which can be used with camshaft adjusting devices can be found in CN 2592932 Y (ZHONG WEISHING).Dec. 5, 2002. and in EP 1316733 A (SIMEONI S.R.L.).Sep. 23, 2002.

The inventors of the present invention were searching for a possibility, as simple and reliable as possible, of producing a defined state in a camshaft adjusting system. For this purpose they considered both changing the camshaft adjusting device in terms of components and taking action in the camshaft adjusting system at other locations, such as at the control, for example.

DE 10344816 A (AISIN SEIKI). - - - . presents a 7/6-way valve which, when the internal combustion engine is switched off, this being called the engine stop signal in the publication, moves a camshaft adjusting system into a particular state by supplying a sufficient quantity of electricity from an ECU in order to initiate a fluid drain function through setting a first regulating mechanism, the response of a blocking mechanism and setting a second regulating mechanism. Not only is it undesirable to integrate 7/6-way valves of a long construction into a cylinder head, but the camshaft adjusting system also requires turn-off run-down times instead of using the start delays for timing adjustment processes. Furthermore, a distinction is made in the method disclosed here between many different states when switching off in the camshaft adjusting system and when draining oil. The approach which is disclosed here appears to lie in constructing a highly complicated system having disadvantages due to its components.

SUMMARY OF THE INVENTION

The object according to the invention is achieved by a camshaft adjusting system according to the characterizing part of the independent claim. Advantageous developments can be found in the dependent claims. A suitable engine is disclosed in the second independent claim. A method according to the invention for operating a camshaft adjusting system according to the invention is disclosed in the third independent claim.

As already indicated, camshaft adjusting systems differ considerably, according to the system. However no camshaft adjusting system is effective without a camshaft adjusting device and a control valve or a control valve group. If the camshaft adjusting device works according to the principle of an oscillating motor camshaft adjusting device or a vane-type camshaft adjusting device, it has at least two opposed hydraulic chambers. When one hydraulic chamber becomes larger, the corresponding opposite hydraulic chamber becomes smaller. There are also oscillating motor camshaft adjusting devices with a high number of hydraulic chambers of the same type which act in the same direction.

The overall behavior is decisive for the control valve group. Irrespective of how the control valve group is constructed, it must as a whole behave like a 4/4-way valve towards the outside, in relation to its interfaces. A 4/4-way valve is a valve which has four defined operating states and interconnects four connections. The connections of the valve according to the invention comprise a connection for the first group of hydraulic chambers of the camshaft adjusting device, a connection for the second group of hydraulic chambers of the camshaft adjusting device, a tank connection and a connection which is supplied with pressurized hydraulic medium, the so-called connection for pressurization.

The control valve group, or the 4/4-way valve, switches the camshaft adjusting system into a first state. The first state is distinguished by the fact that both connections of the valve, which are to lead to the first and second hydraulic chamber groups, are hydraulically short-circuited with respect to the tank connection. There is a hydraulic connection between the tank connection and the connections for the camshaft adjusting device. The hydraulic medium thus flows out of both chambers of the camshaft adjusting device at the same time into a tank container or a tank region, preferably on account of the force of gravity or because of an underpressure. The camshaft adjusting device, previously still pressurized, is as a result switched directly pressureless, without further intermediate steps. It is pressure-relieved with respect to the tank connection. The term "pressureless" is to be understood as meaning that no appreciable pressure remains in relation to the maximum overall pressure in the camshaft adjusting device. The threshold for the insignificant pressure may lie, for example, at 10 percent of the operating pressure. However the term "pressureless" also denotes the state in which virtually all the hydraulic medium has left the camshaft adjusting device through the valve position. Hydraulic oil may still remain in several chambers, depending on the arrangement in the camshaft adjusting device. For example, in a camshaft adjusting device of the central feed duct type, in which a feed duct is brought partly via the camshaft in the centre of the camshaft adjusting device up to the individual advanced chambers, oil remains in the chamber parts which lie gravitationally below the central feed duct. The state is also called pressureless. It is therefore of interest, according to one aspect, that a minimum adjustment can still take place in the pressureless state.

Because the hydraulic oil may be heated, in particular during operation and when switching off the engine, and, according to current exhaust gas standards, the pollutant emission of the internal combustion engine is to be measured at the beginning of an operating cycle, according to one aspect of the invention, the pressureless state, the state I, can ideally be set upon starting the internal combustion engine, preferably passively through biasing forces of a valve spring, for example. Following this setting, the oil can for the most part be drained out of the camshaft adjusting device during the first operating seconds.

According to another aspect of the invention, the camshaft adjusting system may be provided with a check valve which is active for the normal operating phases in the pressurized feed line, while the return to the tank takes place without a check valve in the starting phase.

The described first state of the 4/4-way valve may be called operating end or operating start time state of the camshaft adjusting device. It is an operating end time state because the state is started when the camshaft adjusting system is to be turned off. It is called operating start time state when the adjusting device is put into operation while starting the internal combustion engine into which the camshaft adjusting system is integrated. The camshaft adjusting system is as a rule to be turned off when the internal combustion engine is to be either started, without a load or turned off. It is also possible to speak of an operating end time state when there is an electrical fault which turns off the camshaft adjusting system while the internal combustion engine continues to be operated. The internal combustion engine must be in a controllable and defined state in the phases of the operating end time state. The state is controllable when the relative position of the rotatable camshaft with respect to the reference shaft is known. It is desirable for the state to be taken up in particular when starting the internal combustion engine. In order to avoid complicating the starting of the internal combustion engine unnecessarily, it should be possible to use the initial period of starting the engine to hold the camshaft adjusting device pressureless, even if there were still to be residual oil pressures in the camshaft adjusting system. In conjunction with a suitable central locking system according to, for example, DE 102 53 883 A1, with all embodiments being part of the protective scope of this application for protection, the relative position rotation, once pressureless, is inhibited upon starting the internal combustion engine.

It is as a result of secondary importance for the invention whether the invention has been put into effect by means of a 4/4-way valve or whether an entire control valve group is interconnected such that it exhibits the behavior according to the invention.

There are three further states in addition to the first state. The states may be interchanged. They depend on the actual configuration of the camshaft adjusting system. One state is designed for the retarded adjustment of the camshaft adjusting device. In this state the hydraulic chamber for the retarded adjustment of the camshaft adjusting device is started with pressurized hydraulic medium. One state is intended for the holding position of the camshaft adjusting device. One state is selected when the camshaft adjusting device is to be brought to advance adjustment.

In an advantageously configured system the valve follows a certain state sequence. If the valve is in one state, it can only be moved into an adjacent state. If, therefore, the sequence of a valve according to the invention appears such that, after the operating end time state, the retarded adjustment and subsequently the holding position and, as the fourth, the advance adjustment follow, the valve can only trigger the holding position from the advance adjustment. The valve can be moved both into the operating end time state and into the holding position from the retarded adjustment.

Other sequences are just as conceivable. For example, it is conceivable for the valve to follow the sequences operating end time state, advance adjustment, holding position and retarded adjustment.

An important factor in the case of many valves is for the operating end time state to be the rest position of the valve without adjustment of the piston or of the tappet. A valve of this kind can be put into effect through a cartridge valve which is spring-biased on one side. The spring pushes the piston and the tappet into the rest position, from which the valve only changes over to another state by being energized. A further advantage of the cartridge valve lies in the fact that it can be mounted in an engine block instead of a valve previously used. The manufacturer or operator of an internal combustion engine can therefore improve an existing system by exchanging the valves. The cartridge valve is screwed in as a replacement for the old valve. In order to save construction room and space, the hydraulic piston is designed as a hollow piston which routes the hydraulic medium in its inner region in the direction of the tank connection. The states are attained through the possibility of attaining different overlaps between the hydraulic hollow piston and the individual connections of the valve, according to the travel of the hollow piston. The overlaps lie between the bushing and the hollow piston of the cartridge valve. The systems are compatible with one another with regard to their connection points, such as control unit connection, hydraulic medium connection, and dimensions.

The valve which is described in greater detail in the following is distinguished by the fact that, because of the spatial arrangement of the T-connection relative to the other connections of the 4/4-way valve, the piston retains virtually no residual oil quantities in its first state. An effective contribution towards the pressure relief not just of the camshaft adjusting device, but also of the valve is also achieved through the two armature spaces and the hydraulic preloading of the tappet. Admission openings in the piston are disposed such that no forces against the equilibrium of forces of the valve are produced through the hydraulic medium flowing off to the T-connection.

The camshaft adjusting device is held, moved and set by means of the valve. Together with the camshaft, the camshaft adjusting device is a system which is selected and formed according to positions of equilibrium. If the camshaft adjusting device is switched pressureless, the camshaft, supported on its bearing points, drives a rotor of the camshaft adjusting device together with the camshaft into a dwell position. The defined dwell position is the position of the camshaft adjusting device which is selected automatically. The dwell position is influenced by equilibriums and supports.

A separate locking system may be provided in the camshaft adjusting device in order to attain a distinct dwell position. The locking mechanism, such as, for example, that from DE 102 53 883 A1, takes account of the pressure states in the hydraulic chambers. If the pressure in the hydraulic chambers lies below a certain value, which may be considered in simplified terms as a pressureless state, the camshaft adjusting device locks in and blocks in the selected position. If a pressure difference between the different hydraulic chambers is exceeded, unlocking takes place, the locking mechanism being unlocked.

The described valve and the corresponding camshaft adjusting device, together with an internal combustion engine and a relevant engine control unit, in particular an electronic engine control unit with one or a plurality of microcontroller(s), form a drive unit. The engine control unit separately delivers a signal through which the turn-off state, the operating end time state, is triggered. The turn-off state of the engine control unit is skillfully selected such that the valve also starts out from a turn-off state if the actual engine control unit fails or is turned off. The safety function is called a fail-safe function, because the system enters into a state which is equivalent to the operating end time state if the engine control unit fails or the electrical connections of the valve sustain a mechanical break.

The camshaft adjusting system and the associated internal combustion engine can be used according to a method according to the invention of operating an internal combustion engine, in particular in a motor vehicle, with an electronic engine control unit and a camshaft adjusting system. In the method the first state is taken up upon starting the internal combustion engine with co-ordination between the control unit and the camshaft adjusting system, in particular independently of the process of switching off the internal combustion engine. The start times of the drive train of the motor vehicle, for example the reset and start process of the engine control unit, are used to produce the pressureless state.

BRIEF DESCRIPTION OF THE DRAWINGS

A better understanding of the described invention can be obtained by referring to the following figures, wherein.

PREFERRED EMBODIMENTS OF THE INVENTION

Figure 1:
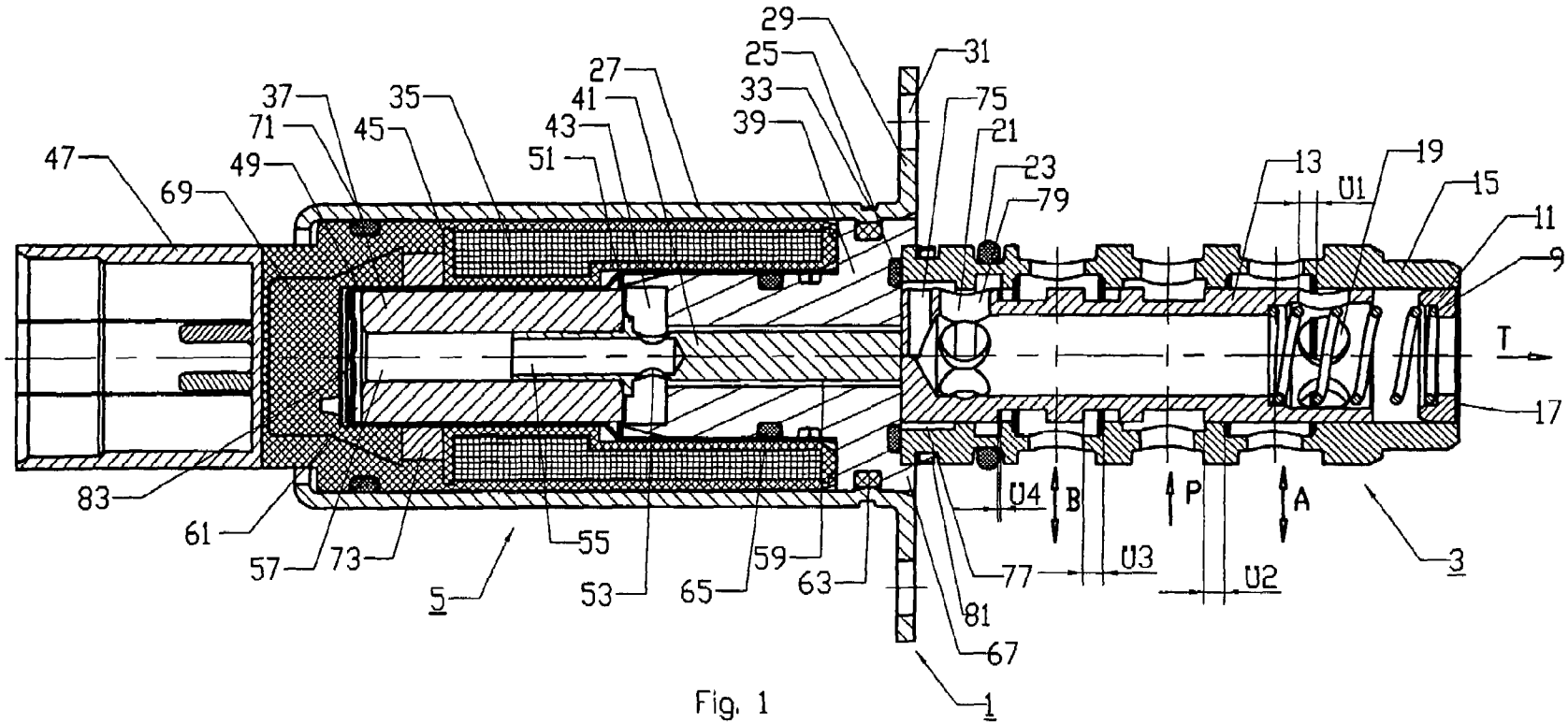
FIG. 1 shows a valve according to the invention in a first operating state.
Figure 2:
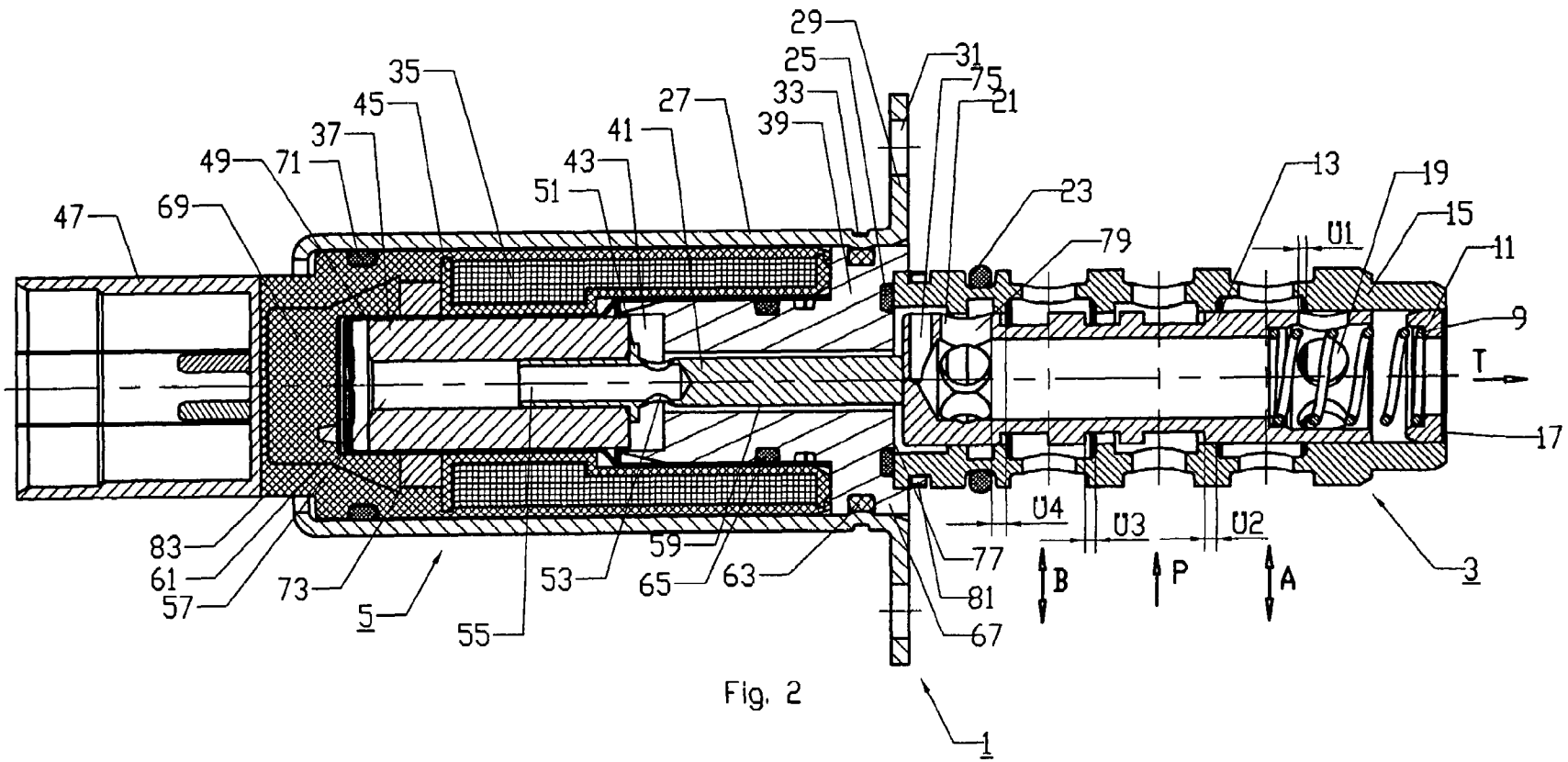
FIG. 2 shows a valve according to the invention in a second operating state.
Figure 3:
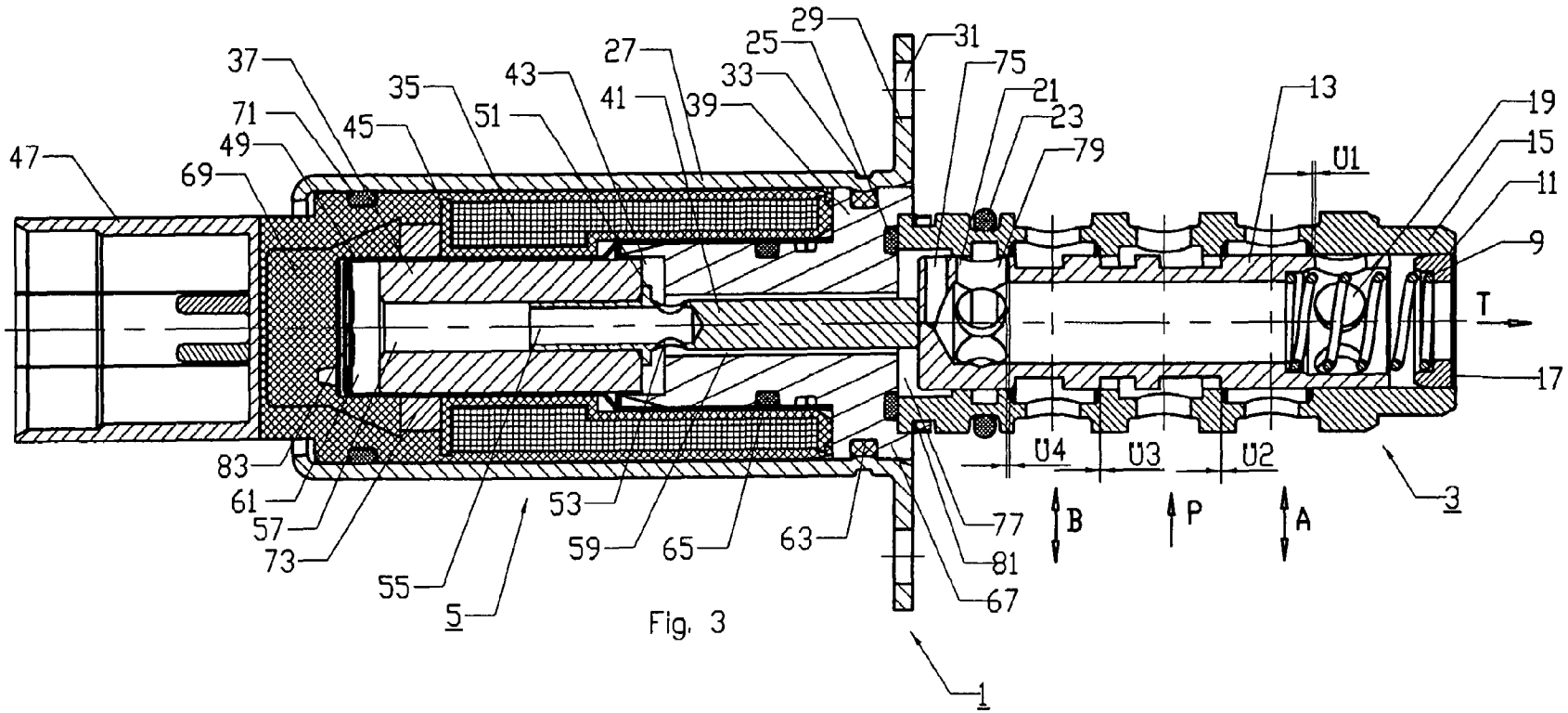
FIG. 3 shows a valve according to the invention in a third operating state.
Figure 4:
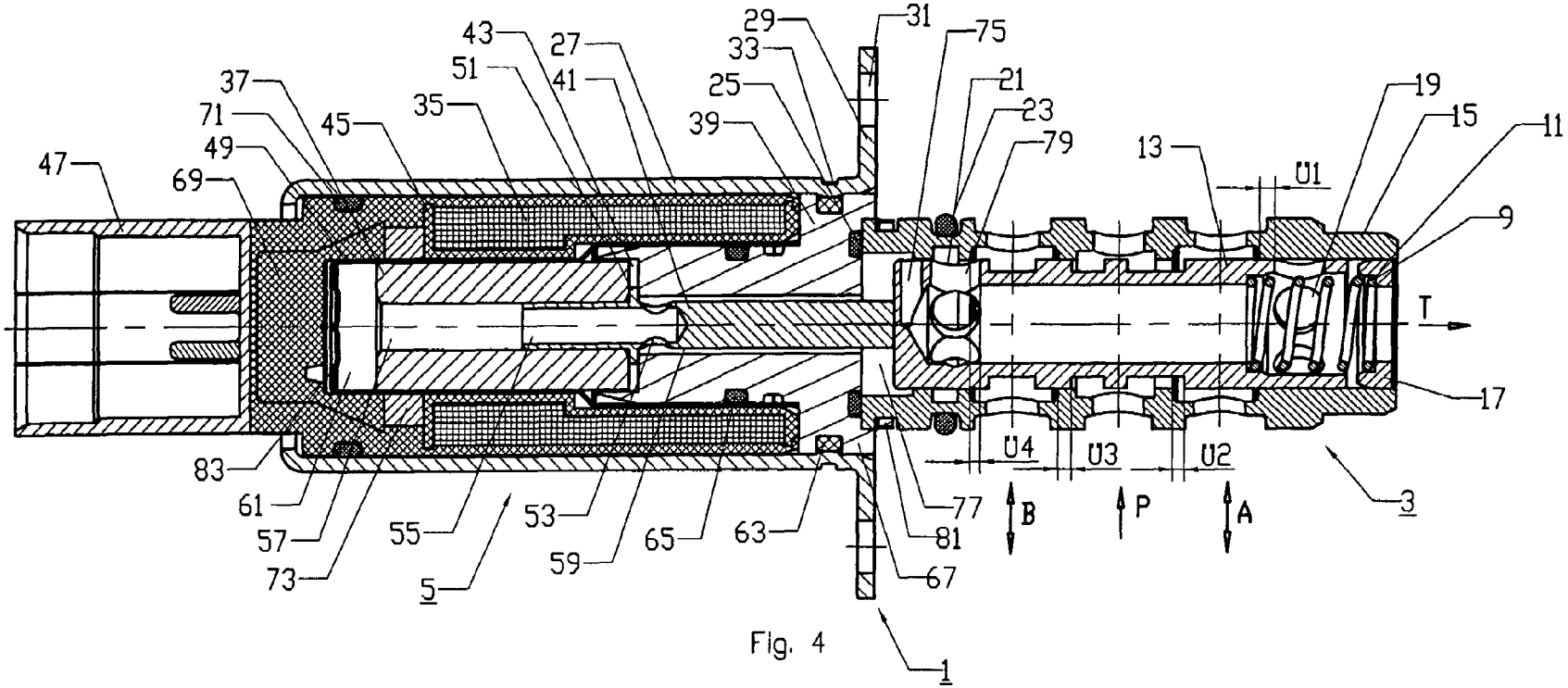
FIG. 4 shows a valve according to the invention in a fourth operating state.

FIG. 1 shows a cartridge valve 1. The cartridge valve 1 consists of a hydraulic part 3 and a magnetic part 5. The hydraulic part 3 has a piston 13 and a sleeve 15. The piston 13 runs inside the sleeve 15. The piston 13 is biased by the spring 9, which is supported with respect to the support collar 11 or spring collar. The sleeve 15 is provided with openings which in the represented case are rotationally symmetrical bores representing the first working connection A, the second working connection B and the pressure connection P: The arrows indicate the regular oil direction. An opening for the T-connection 17, the tank connection T, is provided at the front side of the hydraulic part 3. The T-connection lies at a right angle to the other three connections A, B and P of the valve 1. The opening for the T-connection 17 lies centrally inside the support collar 11. The spring 9 encircles the opening for the T-connection 17. The piston 13 is a hollow piston. The piston 13 is provided with first admission openings 19 and second admission openings 21 which establish the connection to the hollow space of the piston at the diametrically remote ends of the piston. A number of seals are applied in and around the valve, the purpose of which seals is to keep the hydraulic medium away from the environment and the parts not supplied with hydraulic medium during operation. The hydraulic space seal 23 is a circumferential O-ring seal which extends around the sleeve 15 on the side which is remote from the opening for the T-connection 17. It seals the hydraulic region of the cartridge valve 1 off from the environment. As a magnetic part seal, the seal 25 seals the magnetic part 5 off from the hydraulic part 3. The tappet 41, which lies against the piston 13, is a tappet which is preloaded with hydraulic oil and lies in the hydraulic oil. The pole seal 63 and the coil seal 65 ensure that the hydraulic medium which is located in the magnetic part 5 cannot escape externally, outside of the housing 27. The housing 27 passes on its side near the hydraulic part into a flange 29, which is provided with fastening openings, the fastening bores 31. The pole core 39 following the hydraulic part 3 is connected to the housing 27 by beads 33. The beads 33 are disposed in the region of the pole seal 63. A coil 35, the armature 37, the pole core 39 and a tappet 41 are disposed inside the housing 27. The armature 37 lies in a sealing pot 49 and strikes against a driver lug 51. The armature can be reciprocated between two armature spaces, a first armature space 43 and a second armature space 61. The armature spaces are connected in fluid terms to the hydraulic part 3 of the cartridge valve 1 when the piston 13 is outside of its end stop position. The tappet 41 runs in a tappet oil bed 59 which flushes around the tappet and separates it from the pole 67. The tappet oil bed leads into the first armature space 43. The hydraulic medium can pass via a tappet oil duct 55 into the tappet space 57 via tappet transverse bores 53, which may have the function of a damping bore. The tappet space 57 is open with respect to the second armature space 61. The armature 37 travels between its end positions of the two varying armature spaces 43 and 61. The armature spaces are enlarged and diminished through the travel of the armature. The minimum armature space size of the second armature space 61 is attained when the armature 37 comes to a stop at stop faces 83, which are deep-drawn, of the sealing pot 49. An electrical plug 47 is disposed on the side which is opposite the opening for the T-connection 17. The coil 35, which produces the electromagnetic field for the armature 37, lies in a coil carrier 45. An armature cover 69 with a cover seal 71 is provided between the plug 47 and the coil carrier 45. The armature 37 is surrounded by a pole ring 73. A tappet oil space 77 communicates with the opening for the T-connection 17 via a bushing T-compensating duct 75. The connection of the hydraulic part 3 to the magnetic part 5 of the cartridge valve 1 is effected via fastening engagement elements 81. The fastening engagement elements 81 act laterally on the sleeve 15. In the pressureless, in the pressure-relieved, state the piston 13 blocks off the rear hydraulic duct, consisting of the armature spaces 43, 61, the tappet oil bed 59, the tappet oil duct 55 and the tappet space 57, in the magnetic part 5 from the opening for the T-connection 17. The spring 9 undergoes no counterforce and is in its stretched-out, maximally extended and relaxed position. All the hydraulic medium escapes via the opening for the T-connection 17. The connections B and A communicate hydraulically with the opening for the T-connection 17 via corresponding webs in the piston 13 and the admission openings 19 and 21. If the coil 35 is energized by a first, distinctly defined current, the piston 13 moves into a second position, the second state II, starting from the first state I. As represented in FIG. 2, the webs at the piston 13 now have a different overlap with respect to the sleeve 15. Upon further energization of the coil 35 with current which is higher than the current for the state II, the cartridge valve I enters the third state II. The third state III is represented in FIG. 3. On account of the overlap between the piston 13 and the sleeve 15, in this state the first working connection A and the second working connection B are disconnected both from the tank connection T and from the pressure connection P. In the fourth state IV, which is illustrated in FIG. 4, there is a hydraulic connection between the pressure connection P and the first working connection A on account of a further movement against the spring force of the spring 9, and driven by the tappet 41. The second working connection B is connected to the tank connection T via the T-outlet duct 79 and the second admission opening 21. In the fourth state the armature 37 is at its end stop, it is only separated from the pole 69 by the driver lug 51.

Tappet bores in the form of damping bores delay the method in the first state. Short oil pressure or energization interruptions of the coil are as a result compensated. Although the operation is carried out with a pressureless state, the camshaft adjusting system as a whole becomes more stable than known camshaft adjusting systems.

The openings, bores and ducts and the entire valve are graphically represented in a rotationally symmetrical manner. It is understood that the rotationally symmetrical form of the valve naturally has no influence on the implementation of the invention.

The piston 13 has three grooves, two webs and two end elevations, which lie in the two outer end regions of the tappet. The sleeve 15 comprises inner webs which, together with the sleeve, can block the connections relative to one another. A suitable valve may, for example, be designed such that there is an overlap of 0.2 to 0.4 mm between the sleeve 15 and the piston 13 in the region of the connection D to the groove of the T-outlet duct 79. The overlap between the P-connection and the connection B may vary between 0.25 and 0.45 mm. The overlap between the P-connection and the connection A exceeds 1 mm, being 1.5 mm, for example.

Figure 5:
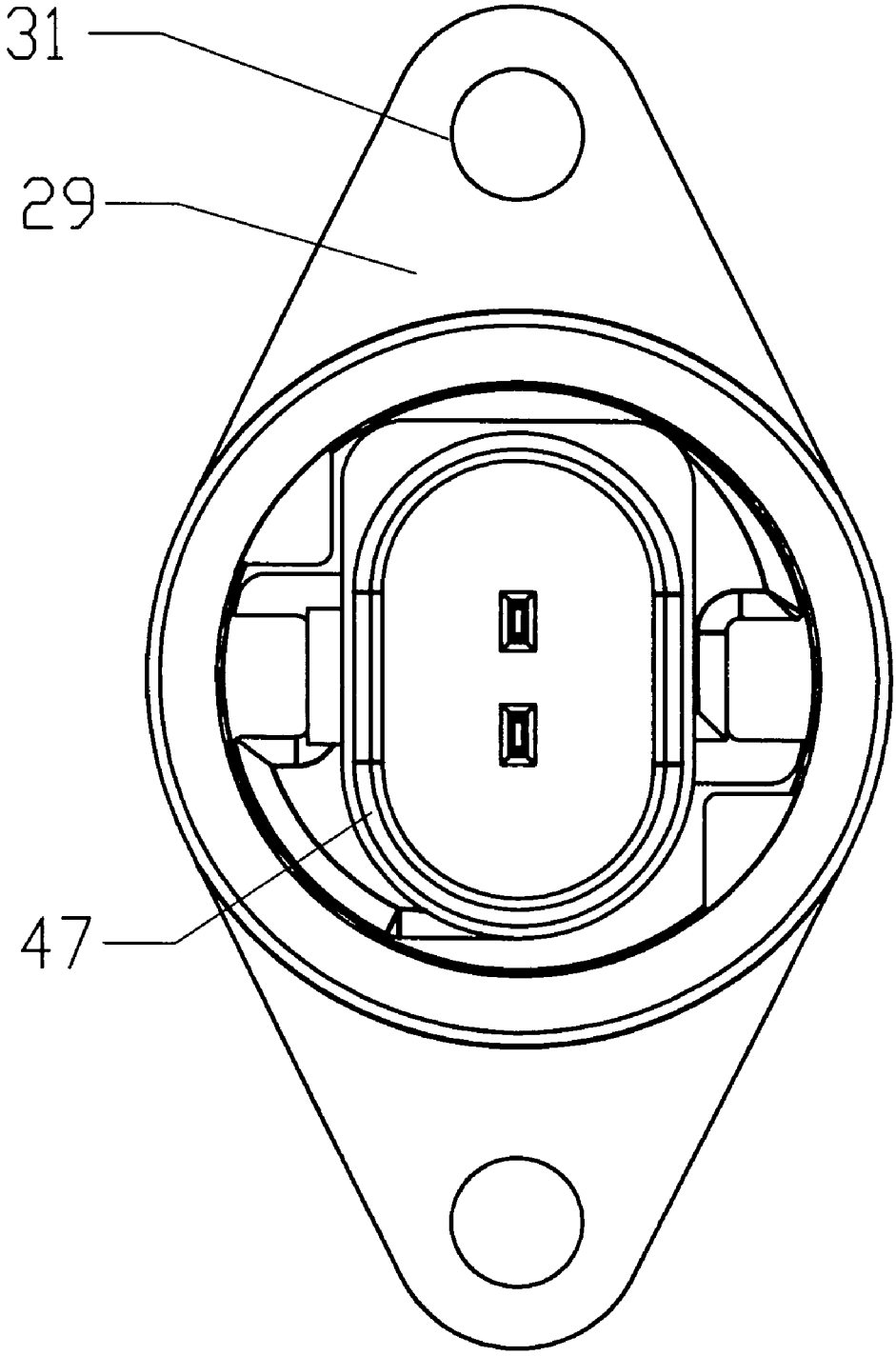
FIG. 5 is a plan view of a valve according to the invention.

The valves depicted in the sectional drawings of FIGS. 1 to 4 are represented in a manner similar to that of FIG. 5 in plan view. Looking perpendicularly onto the valve, the plug 47, the flange 29 and the fastening bore 31 are obvious.

Figure 6:
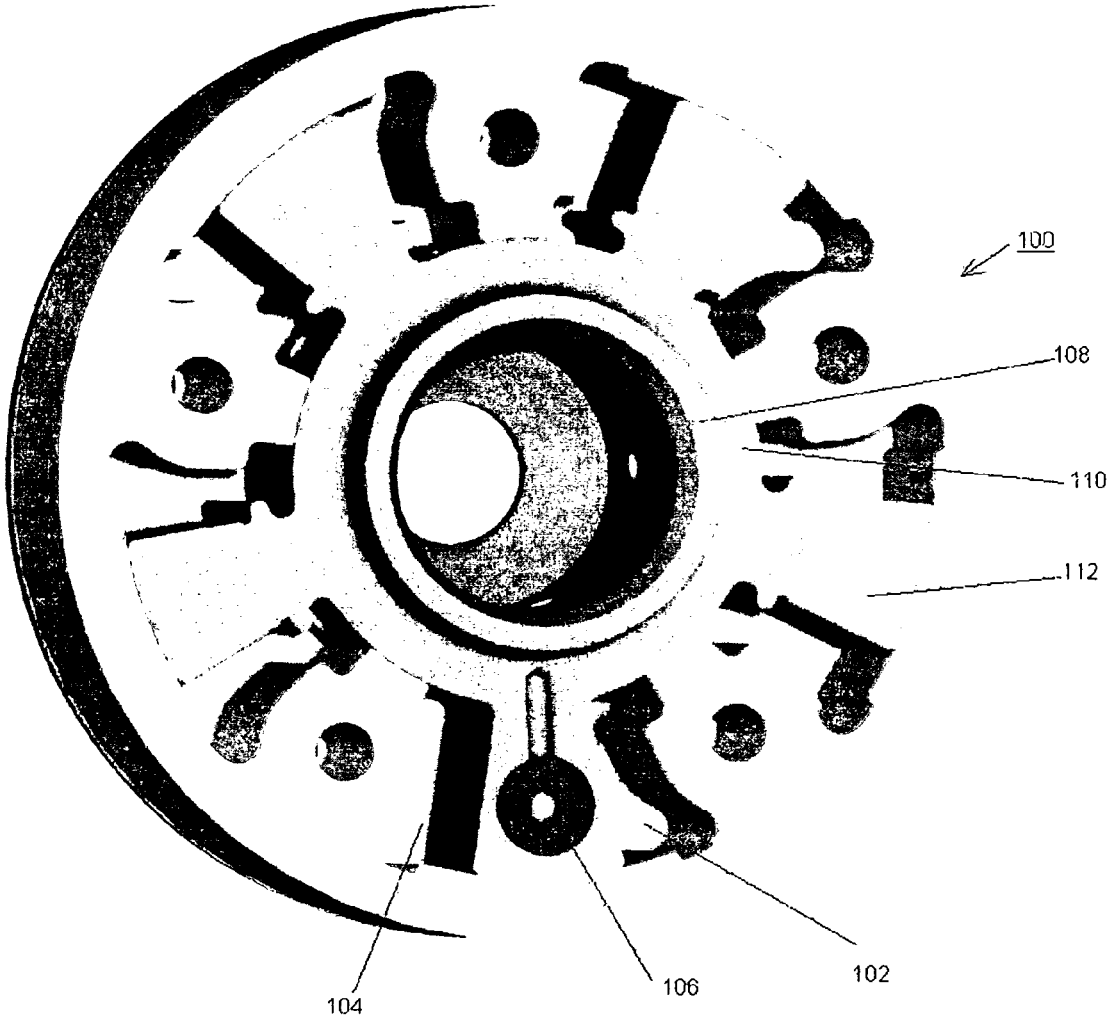
FIG. 6 shows a camshaft adjusting device in a regular position.
Figure 7:
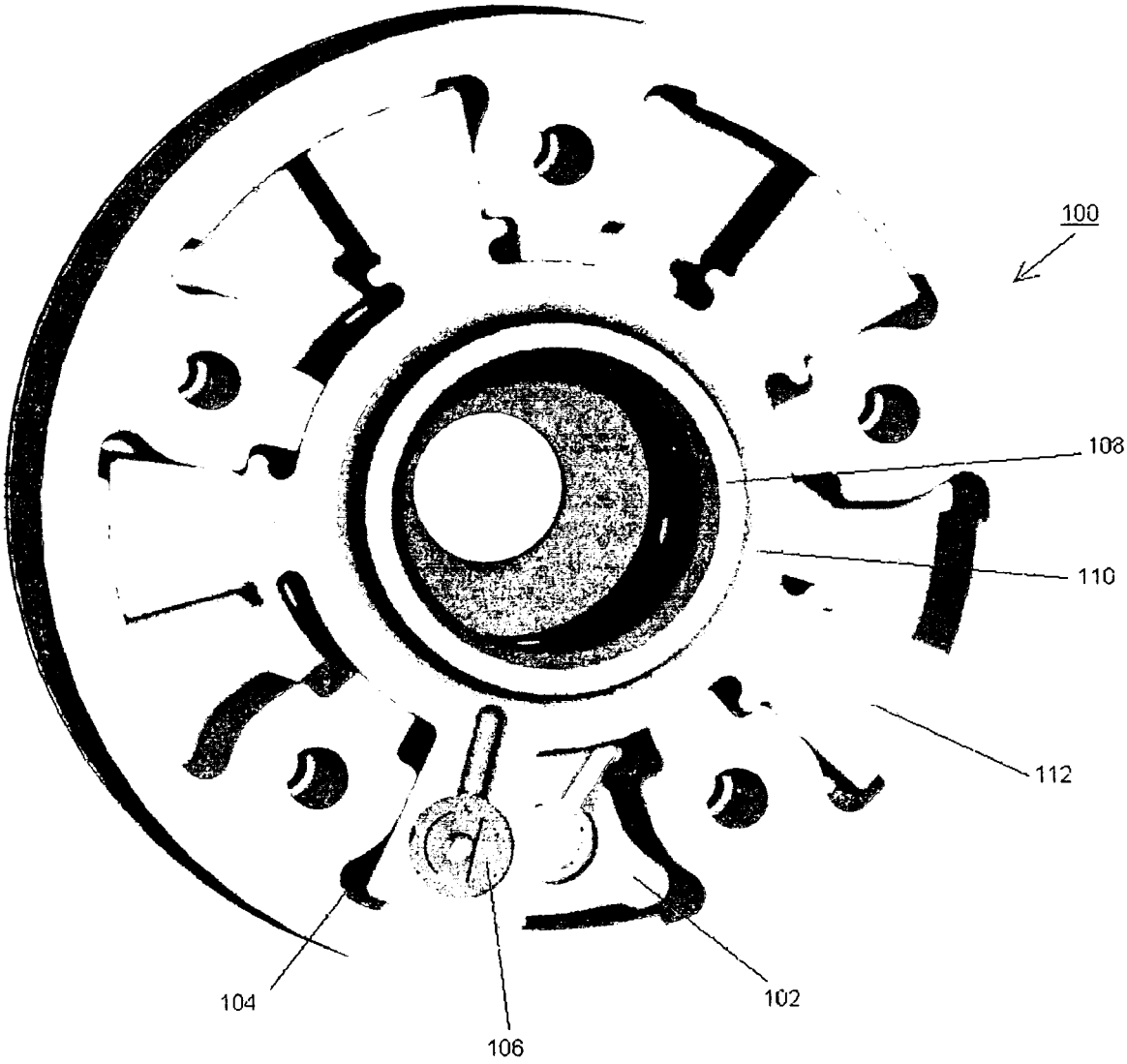
FIG. 7 shows a camshaft adjusting device in an advance position.
Figure 8:
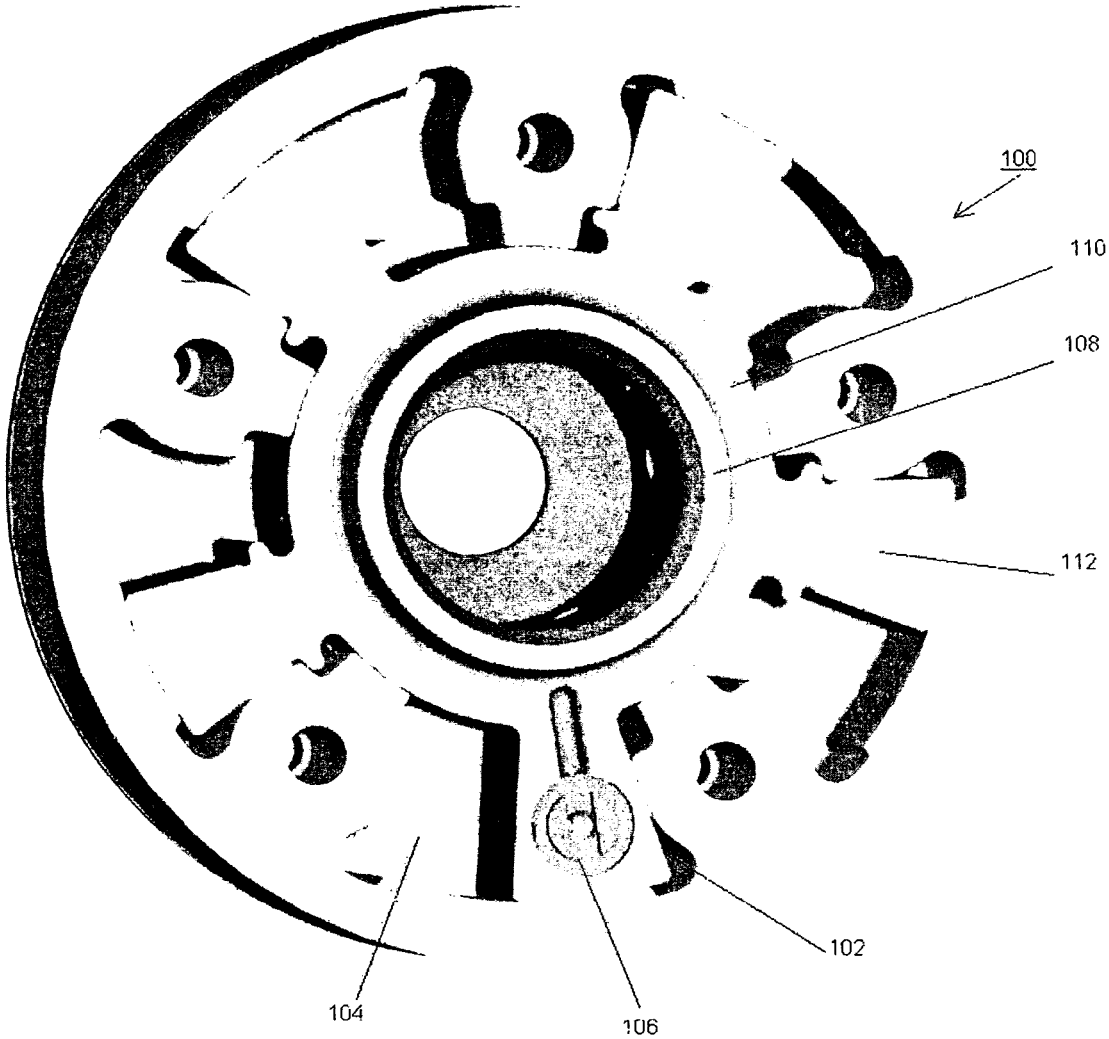
FIG. 8 shows a camshaft adjusting device in a retarded position.

The described cartridge valve 1 is hydraulically connected directly or via lines of the engine compartment indirectly to a camshaft adjusting device, which is illustrated in an open representation in FIGS. 6, 7 and 8. The illustrated camshaft adjusting device is in its regular position in FIG. 6, turned into its advance position in FIG. 7 and into its retarded position in FIG. 8. The camshaft adjusting device 100 forms in its interior at least two hydraulic chambers 102, 104 which in each case, when present in multiple form, occur alternately. The housing of the camshaft adjusting device 100, together with the rotor, consisting of the rotor ring 110 and rotor vanes 112, forms the hydraulic chambers 102, 104. A locking mechanism 106 may optionally be mounted in one of the vanes. The rotor ring 110 surrounds a camshaft mount 108, in which the camshaft, which is not represented, lies. Certain rotor vane geometries of the rotor vanes 112 and web geometries of the camshaft adjusting device 100 are shown in the illustrations. The geometries are of secondary importance for the present invention.

Figure 9:
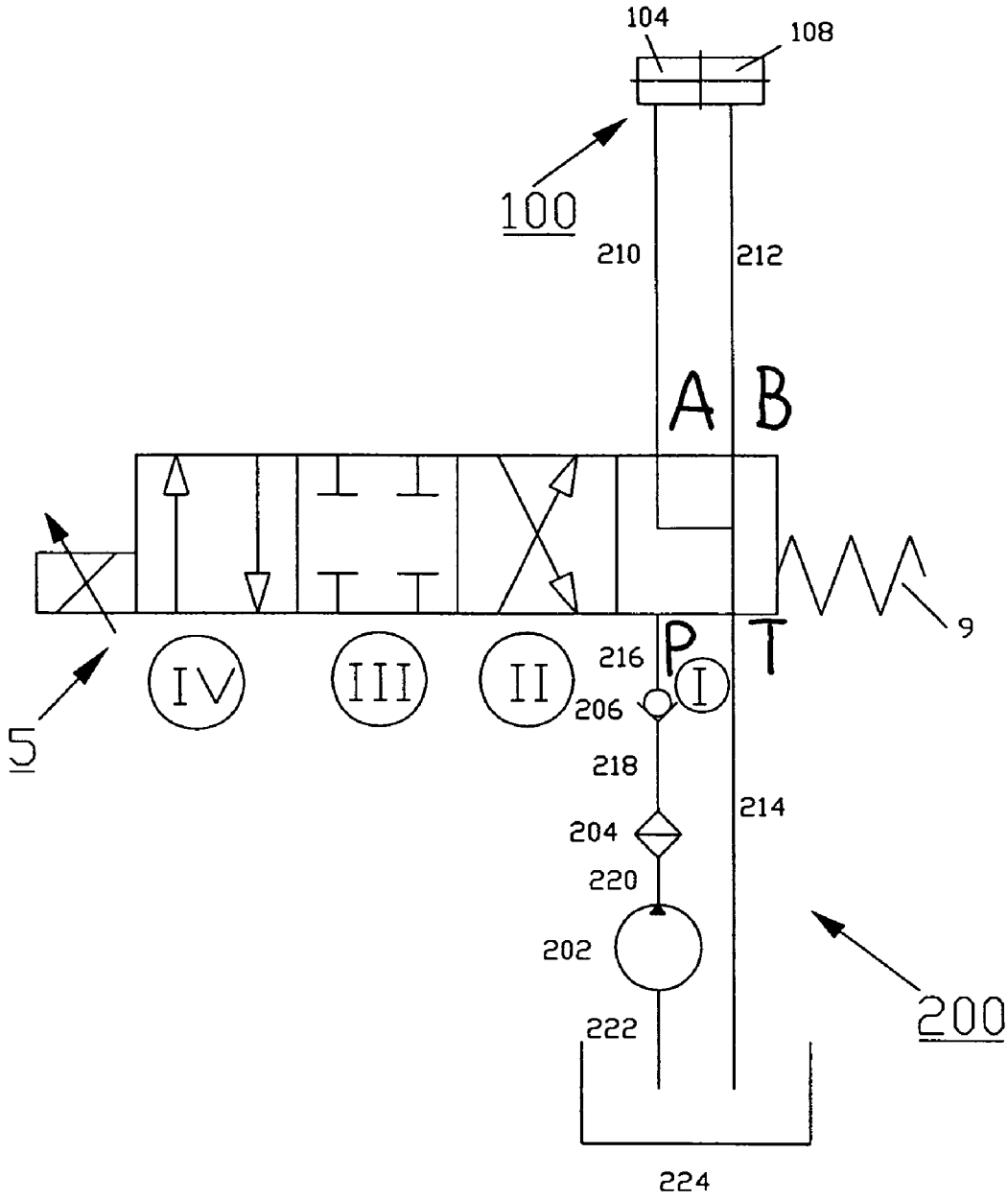
FIG. 9 shows a basic hydraulic circuit diagram of the invention.

FIG. 9 represents a system according to the invention with its lines. The valve 1 is represented as a hydraulic circuit symbol, in which the magnetic part 5 and the spring 9 are represented as individual parts. The valve exhibits the 4 states I, II, III, IV. The working side with the connections A and B is connected via the lines 210, 212 to the camshaft adjusting device 100, which has been represented in a simplified form as a hydraulic twin-chamber piston. The two chambers 102 and 104 of the camshaft adjusting device 100 act in opposition. The check valve 206, the filter 204, which may also be a separator, and the pump 202 are optional in a camshaft adjusting system 200. Further construction parts and hydraulic components may also be disposed in a system. The hydraulic medium is returned to the tank 224 via the connecting line 214. The pump 202 accesses the tank via the connecting line 222 and delivers the hydraulic medium to the filter 204 via the connecting line 220. The filter 204 is connected by means of a connecting line 218 to a check valve 206 before this leads via the connecting line 216 to the hydraulic valve 1.

Figure 10:
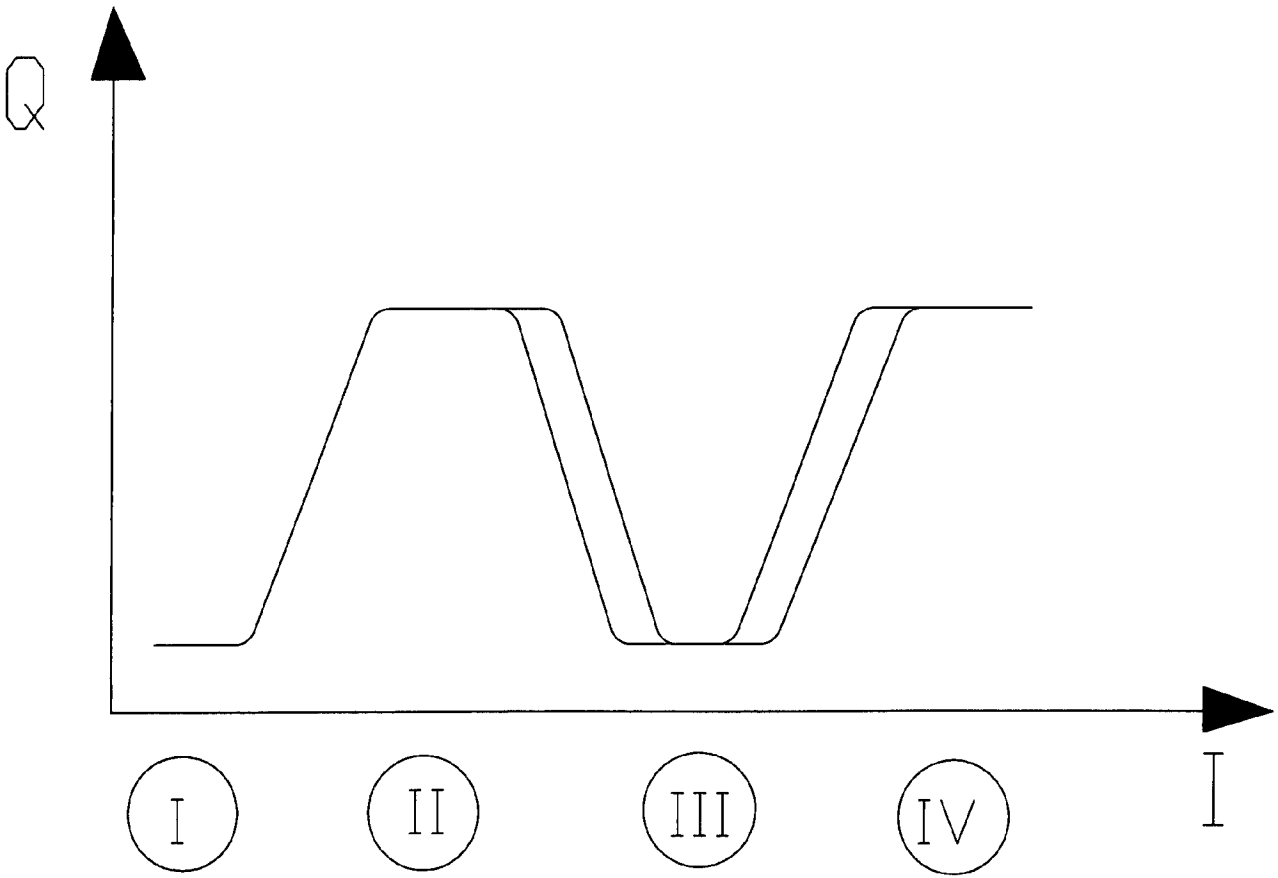
FIG. 10 shows a current-pressure medium flow diagram of a valve according to the invention.

The flow volumes are represented in FIG. 10 for their respective states. The flow volume is plotted against the current of the coil in FIG. 10. The states II and IV have corresponding flow volumes. The flow is either interrupted or reversed at the connection A in the states 1 and 3.

Figure 11:
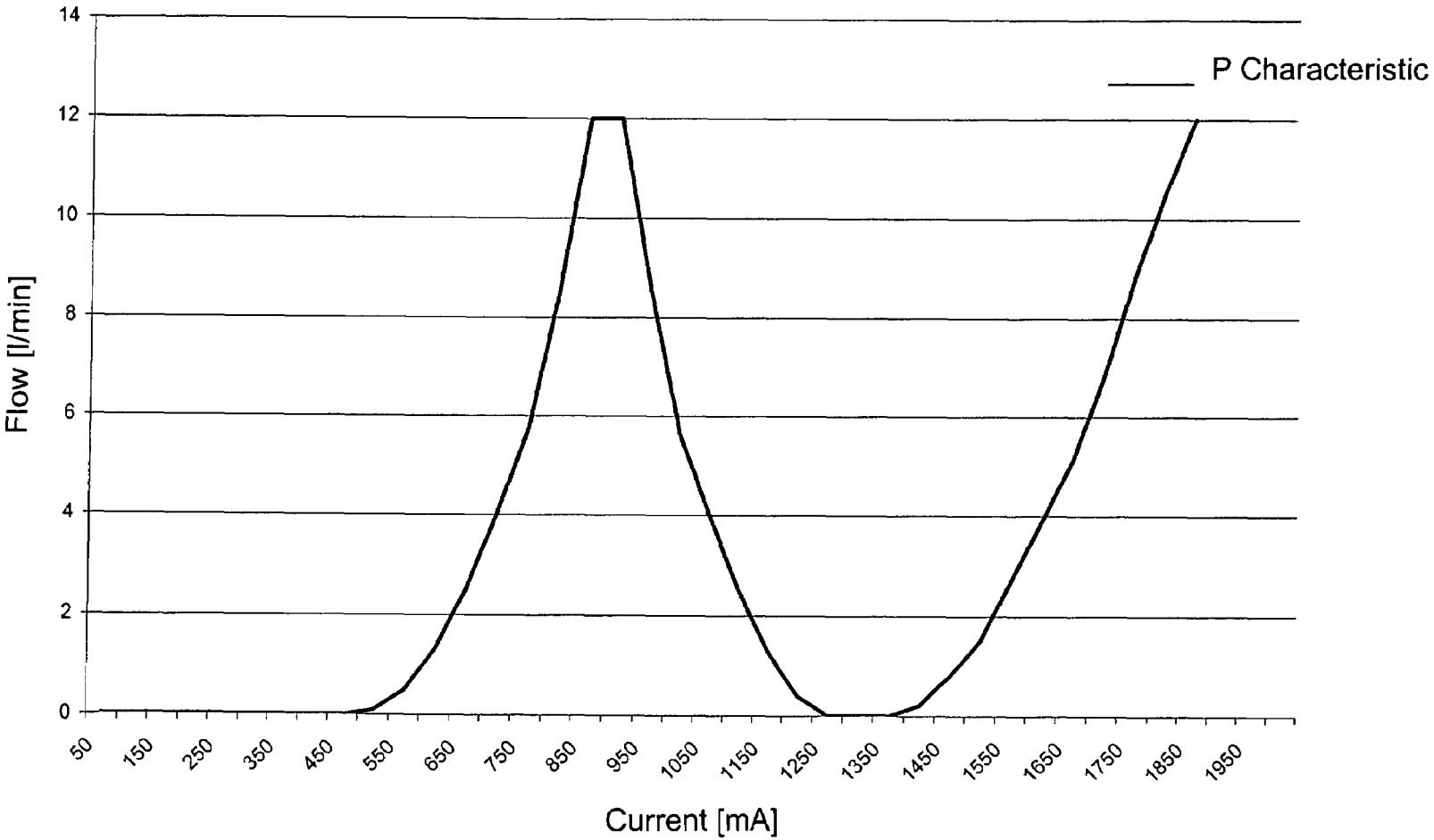
FIG. 11 shows a hydraulic characteristic of a real valve according to the invention.

The characteristic idealized in FIG. 10 will in reality appear as represented in FIG. 11, for example. The energization regions are all of the same width. A control unit can be programmed by means of the diagram such that a certain pulse-width-modulated signal or a certain current from the engine control unit is delivered in order to start one of the selected states I, II, III, IV.

Figure 12:
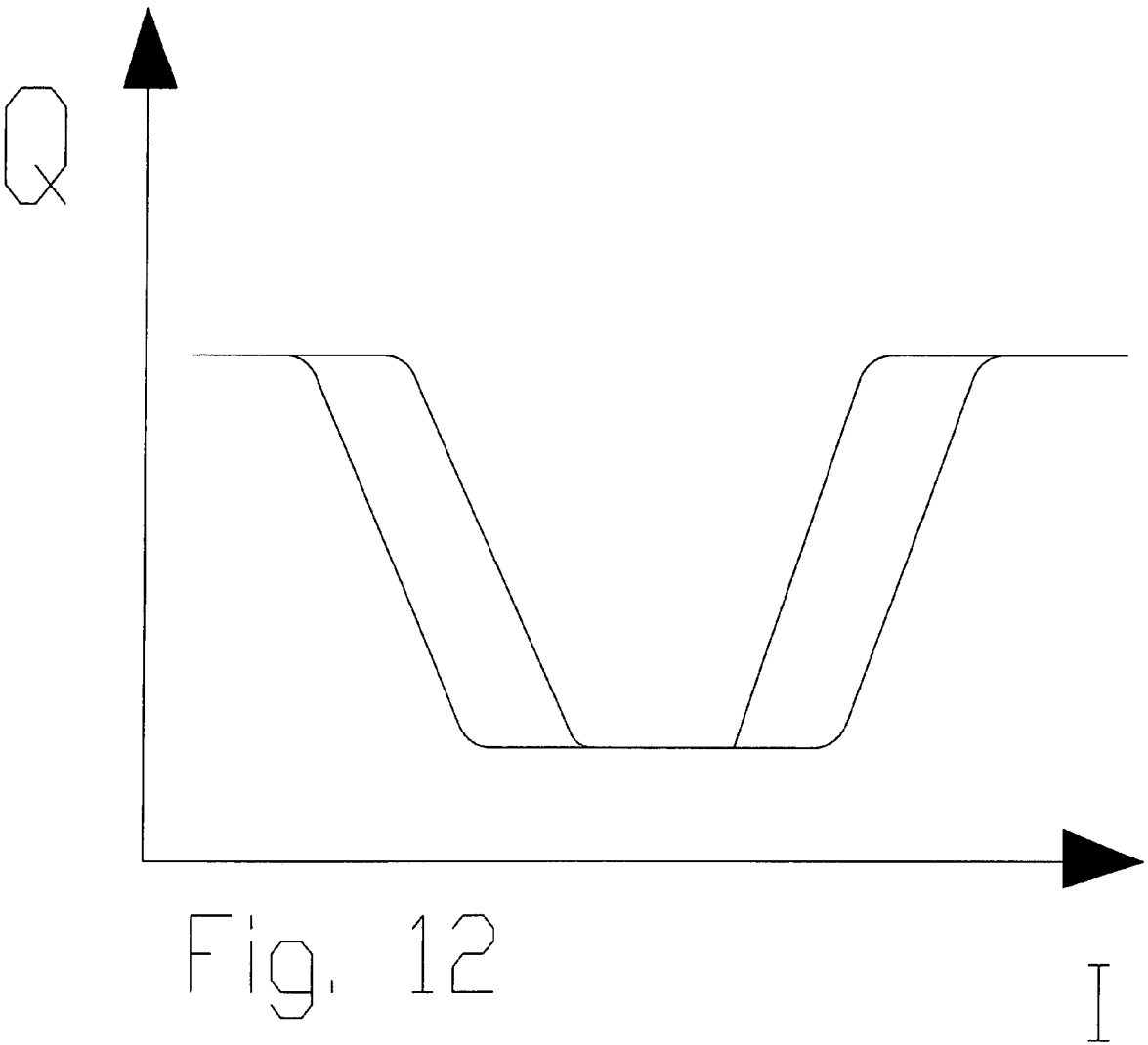
FIG. 12 shows a flow characteristic of the in-house prior art.
Figure 13:
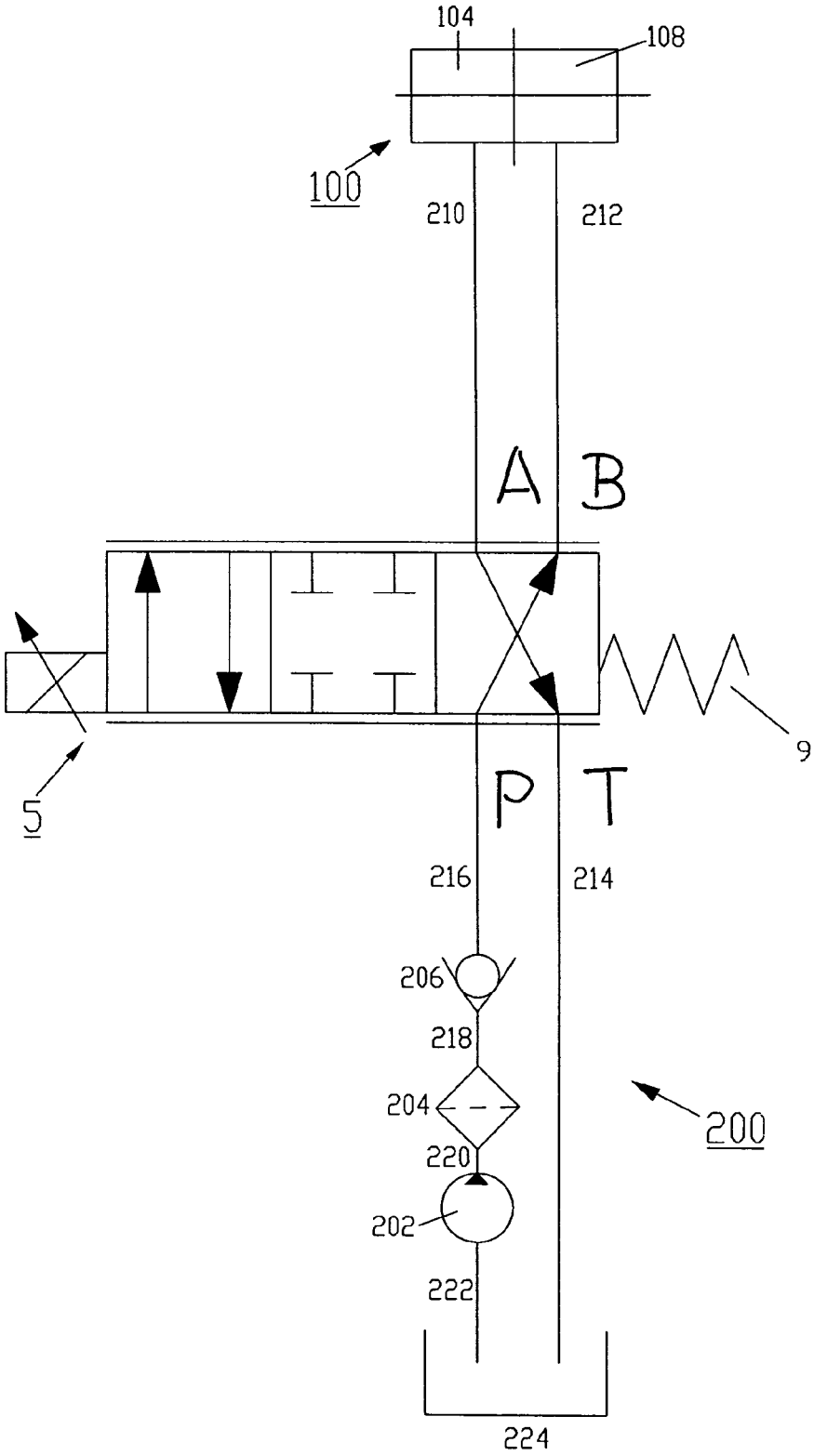
FIG. 13 shows a valve previously used in-house in a basic representation.

FIG. 13 illustrates a system previously used in-house which can be improved by substituting the valve according to the invention. The flow-current characteristic associated with FIG. 13 can be seen in FIG. 12.

To summarize, it can therefore be maintained that, according to one aspect of the invention, known camshaft adjusting systems are developed by having selected a pressureless state as selectable and accessible state. A further aspect of the invention lies in the fact that a suitable valve has been designed which reliably permits the pressureless state of the camshaft adjusting system. The two aspects combined result in a camshaft adjusting system according to the invention. Existing camshaft adjusting systems can be changed into a system according to the invention by replacing the valve and directions for reprogramming the control unit of the internal combustion engine.

LIST OF REFERENCE CHARACTERS

TABLE 1

| Reference character | Name |
|---|---|
| 1 | cartridge valve |
| 3 | hydraulic part |
| 5 | magnetic part |
| 9 | spring |
| 11 | support collar |
| 13 | piston |
| 15 | sleeve |
| 17 | opening for T-connection |
| 19 | first admission opening |
| 21 | second admission opening |
| 23 | hydraulic space seal |
| 25 | magnetic part seal |
| 27 | housing |
| 29 | flange |
| 31 | bore (for fastening) |
| 33 | bead for housing fastening |
| 35 | coil |
| 37 | armature |
| 39 | pole core |
| 41 | tappet |
| 43 | armature space |
| 45 | coil carrier |
| 47 | plug |
| 49 | sealing pot |
| 51 | driver lug |
| 53 | tappet transverse bore having the function of a damping bore |
| 55 | tappet oil duct |
| 57 | tappet space |
| 59 | tappet oil bed |
| 61 | second armature space |
| 63 | pole seal |
| 65 | coil seal |
| 67 | pole |
| 69 | armature cover |
| 71 | cover seal |
| 73 | pole ring |
| 75 | bushing T-compensating duct |
| 77 | tappet oil space |
| 79 | T-outlet duct |
| 81 | fastening engagement elements |
| 83 | stop face |
| 100 | camshaft adjusting device |
| 102 | first hydraulic chamber |
| 104 | second hydraulic chamber |
| 106 | locking mechanism |
| 108 | camshaft mount |
| 110 | rotor ring |
| 112 | rotor vanes |
| 200 | camshaft adjusting system |
| 202 | pressurisation, e.g. pump |
| 204 | filter/separator |
| 206 | check valve |
| 210 | connecting line (between valve and camshaft adjusting device) |
| 212 | connecting line (between valve and camshaft adjusting device) |
| 214 | connecting line (between valve and tank) |
| 216 | connecting line (between check valve and valve) |
| 218 | connecting line (between check valve and filter) |
| 220 | connecting line (between filter and pump) |
| 222 | connecting line (between pump and tank) |
| 224 | tank |
| I | first state |
| II | second state |
| III | third state |
| IV | fourth state |
| A | working connection 1 |
| B | working connection 2 |

TABLE 1-continued

| Reference character | Name |
|---|---|
| T | tank connection |
| P | pressure connection |

What is claimed is:

1. A camshaft adjusting system for an internal combustion engine, the camshaft adjusting system comprising:

a camshaft adjusting device with a first hydraulic chamber and a second hydraulic chamber, wherein the first and second hydraulic chambers act in opposition to one another;

a control valve group working as a 4/4-way valve system and comprising a first connection to the first hydraulic chamber, a second connection to the second hydraulic chamber, a tank connection, and a connection for pressurization, wherein the control valve group has only a first state, a second state, a third state, and a fourth state;

wherein the camshaft adjusting system in the first state of the control valve group, when starting the internal combustion engine, is pressure-relieved relative to the tank connection by simultaneously hydraulically connecting the first and second connections of the camshaft adjusting device so that the camshaft adjusting device moves into a dwell position with a single locking mechanism and said dwell position also provides a safety function in case of system failure, which dwell position is selected automatically and independently of the process of switching off the internal combustion engine.

2. A camshaft adjusting system according to claim 1, wherein the control valve group is a single 4/4-way valve.

3. A camshaft adjusting system according to claim 2, wherein the dwell position is reached passively.

4. A camshaft adjusting system according to claim 2, wherein the first state is the operating end time state of the camshaft adjusting system.

5. A camshaft adjusting system according to claim 2, wherein the second state provides a retarded adjustment of the camshaft adjusting device, wherein in the second state the first connection is connected to the tank connection and the second connection is connected to the connection for pressurization; wherein the third state provides a holding position of the camshaft adjusting device, in which holding position the first and second connections are simultaneously disconnected from the tank connection and the connection for pressurization; wherein the fourth state provides an advance adjustment of the camshaft adjusting device, in which fourth state the first connection is connected to the connection for pressurization and the second connection is connected to the tank connection.

6. A camshaft adjusting system according to claim 5, wherein the first, second, third, and fourth states are adjusted by a linear movement of a hydraulic piston of the 4/4-way valve, wherein the first, second, third, and fourth states are sequentially reached in accordance with the ordinal number assigned to the first, second, third, and fourth states, respectively, wherein a movement between the first, second, third, and fourth states is possible into a state of the next higher or next lower ordinal number.

7. A camshaft adjusting system according to claim 5, wherein the 4/4-way valve is a cartridge valve that is spring-loaded at one end and comprises a sleeve and a hydraulic hollow piston adapted for tank pressure relief, wherein the first, second, third, and fourth states are determined by an overlap between the hollow piston and the sleeve.

8. A camshaft adjusting system according to claim 1, wherein, when the camshaft adjusting system is pressure-relieved, the camshaft adjusting device automatically moves into the dwell position during the period of the first state.

9. A camshaft adjusting system according to claim 1, wherein the locking mechanism locks in the first state and unlocks when a predetermined pressure difference between the first and second hydraulic chambers is exceeded.

10. A camshaft adjusting system according to claim 1, wherein the camshaft adjusting device is an oscillating motor camshaft adjusting device.

11. An internal combustion engine comprising an engine control unit and a camshaft adjusting system according to claim 1, wherein a turn-off state of the camshaft adjusting system is determined by a no-load voltage, a no-load current, or a no-load pulse-width signal when dropping below a threshold value.

12. A camshaft adjusting system according to claim 1, wherein the first state is produced by a reset and start process of an engine control unit.

13. A camshaft adjusting system according to claim 1, wherein in case of a failure the camshaft adjusting system enters into a fail-safe state that is equivalent to an operating end time state of the camshaft adjusting system.

14. A camshaft adjusting system according to claim 1, wherein the dwell position is achieved by an equilibrium of the camshaft.

15. A camshaft adjusting system according to claim 1, further comprising a check valve that is active for the normal operating phases.

* * * * *